US007389882B2

(12) United States Patent
Cady et al.

(10) Patent No.: US 7,389,882 B2
(45) Date of Patent: Jun. 24, 2008

(54) MULTI-HARDNESS COMPOSITE SCREEN FRAME

(75) Inventors: Eric Cady, Florence, KY (US); Brian Carr, Burlington, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 11/774,829

(22) Filed: Jul. 9, 2007

(65) Prior Publication Data

US 2007/0267332 A1 Nov. 22, 2007

Related U.S. Application Data

(63) Continuation-in-part of application No. 11/128,787, filed on May 13, 2005, now Pat. No. 7,249,677.

(51) Int. Cl.
*B07B 1/49* (2006.01)
*B07B 1/50* (2006.01)

(52) U.S. Cl. ..... 209/405; 209/379; 209/385; 209/408; 209/411

(58) Field of Classification Search ..... 209/405, 209/408, 379, 385; 160/317
See application file for complete search history.

(56) References Cited

U.S. PATENT DOCUMENTS 4,021,337 A 5/1977 Wehren
4,141,821 A * 2/1979 Wolff ..... 209/405
4,265,742 A * 5/1981 Bucker et al. ..... 209/399
4,341,627 A 7/1982 Heilhecker
4,375,408 A 3/1983 Anderson
4,413,822 A * 11/1983 Fernandez et al. ..... 473/536
4,655,907 A 4/1987 Ando
4,832,834 A 5/1989 Baird, Jr.
5,059,310 A 10/1991 Fischer et al.
5,819,952 A * 10/1998 Cook et al. ..... 209/400
5,840,412 A 11/1998 Wood et al.
5,927,511 A * 7/1999 Riddle et al. ..... 209/405

(Continued)

FOREIGN PATENT DOCUMENTS

JP 2002-001220 A 1/2002

OTHER PUBLICATIONS

Office Action dated Jul. 25, 2006 for U.S. Appl. No. 11/128,767, filed May 13, 2005.

(Continued)

*Primary Examiner*—Patrick Mackey
*Assistant Examiner*—Terrell H Matthews

(57) ABSTRACT

A self-cleaning screen assembly for a vibratory separator is disclosed. The self-cleaning screen assembly includes a peripheral frame having a top mounting surface to which at least one screen cloth is affixed and a bottom mounting surface to which a flow through support screen is affixed. One or more cleaning elements are freely located between the support screen and the screen cloth. The peripheral frame includes a rigid support section, a cushioned top strain relief zone, and a cushioned bottom strain relief zone. The top strain relief zone, the bottom strain relief zone and the rigid support section may be discrete components wherein the strain relief zones are formed by strain relief pads that are located adjacent to a rigid support member. The top strain relief zone provides cushioned support to the screen cloth around the edge of the screen frame adjacent to the opening. The bottom strain relief zone provides cushioning for the support screen.

16 Claims, 7 Drawing Sheets

U.S. PATENT DOCUMENTS

| | | | | |
|---|---|---|---|---|
| 5,950,841 | A * | 9/1999 | Knox et al. | 209/315 |
| 6,095,339 | A * | 8/2000 | Filip | 209/382 |
| 6,581,781 | B1 | 6/2003 | Adams et al. | |
| 6,713,190 | B2 | 3/2004 | Cook et al. | |
| 6,736,271 | B1 | 5/2004 | Hall | |
| 6,759,000 | B2 | 7/2004 | Cook et al. | |
| 7,000,776 | B2 * | 2/2006 | Winkler et al. | 209/399 |
| 7,000,777 | B2 | 2/2006 | Adams et al. | |
| 7,059,682 | B2 * | 6/2006 | Caruso et al. | 297/452.46 |
| 7,150,358 | B2 * | 12/2006 | Carr et al. | 209/403 |
| 7,249,677 | B2 * | 7/2007 | Cady et al. | 209/403 |
| 2004/0255527 | A1 | 12/2004 | Chen | |
| 2005/0224398 | A1 | 10/2005 | Largent et al. | |
| 2006/0103222 | A1 | 5/2006 | Caruso et al. | |

OTHER PUBLICATIONS

International Search Report and Written Opinion dated Oct. 11, 2006 for PCT/US2006/018800, filed May 15, 2006.

* cited by examiner

MULTI-HARDNESS COMPOSITE SCREEN FRAME

This is a continuation-in-part of U.S. patent application Ser. No. 11/128,787 filed May 13, 2005, now U.S. Pat. No. 7,249,677, entitled, "Dual Hardness Composite Screen Frame," to which priority is claimed and the contents of which are hereby incorporated by reference.

BACKGROUND OF INVENTION

Screen assemblies are used in vibratory separators to sort "oversized" particles from fluid or other particles. Screen assemblies include a wire or synthetic mesh screen cloth that is affixed to a frame. The frame is retained by the separator and product to be sorted is introduced to the top surface of the screen cloth. The combination of vibratory forces and product weight strains each wire in the screen cloth near the frame. Such strain varies from wire to wire around the edge of the screen assembly. Once a first wire yields or breaks under the strain, nearby wires are placed under greater strain and the break often widens across several wires.

Typically, screen assemblies used in vibratory separators have either steel, thermoset, or composite thermoplastic frames. The screen cloth is attached to a steel frame by spot welding or by using and adhesive. The screen cloth is attached to a thermoset frame by using an adhesive. For either attachment method, strain relief must be provided at the interface of the screen cloth and the frame when there is a large area of unsupported mesh. Typically, a bead of silicone or other caulking-type of elastomer bead is manually applied to the frame to provide strain relief to the screen cloth. However, the bond between silicone and steel is not always strong, resulting in pieces, or strings, of silicone breaking free from the frame and screen cloth to contaminate the product being processed by the vibratory separator. Silicone is chemically undesirable to many end users. Further, early screen failure can occur when individual wires in the area of the lost strain relief are subjected to strain and fatigue, causing them to break. The use of a silicone bead typically extends cure time and thereby manufacturing costs. In addition, application of the silicon bead to the frame is often performed manually, which results in an inconsistent bead size and variations in the amount of material used from screen to screen. Such inconsistency is often observed between screens manufactured by a single operator as well as between screens manufactured by different operators.

The screen cloth typically is attached to rigid composite thermoplastic frames by first heating the thermoplastic material and then pressing the mesh into the soft thermoplastic, which is allowed to cool. The current or existing composite frame includes an internal mesh support grid that divides the screening area into relatively small discreet zones. The zones are each small enough that a strain relief is not necessary at the interface of the mesh and the outer frame. However, the internal support grid utilizes valuable sorting area, leaving less area for processing.

It would be an improvement to the art to have a screen assembly wherein the frame includes a strain relief zone providing sufficient strain support to the screen cloth to eliminate the need for an internal grid to support the screen cloth, or if an internal grid is required, to provide strain support so that large mesh spans between ribs are feasible.

It would also be an improvement to the art to have a screen assembly that can be manufactured in a process that is repeatable by a single operator and reproducible by different operators. It would also be an improvement to have a screen that may be manufactured using automated equipment to further improve the consistency between screen assemblies. In addition to improving the quality of the screen assembly, the improved uniformity of screen assemblies would also result in a more predictable screen life. It would also be an improvement to have a screen that does not require the use of an adhesive or silicone which can take a relatively long time to cure during screen manufacturing.

SUMMARY

In one aspect, the claimed subject matter is generally directed to a self-cleaning screen assembly for a vibratory separator. The self-cleaning screen assembly includes a peripheral frame having a top mounting surface to which at least one screen cloth is affixed and a bottom mounting surface to which a flow through support screen is affixed. One or more cleaning elements are freely located between the support screen and the screen cloth. The peripheral frame includes a rigid support section, a cushioned top strain relief zone, and a cushioned bottom strain relief zone. The top strain relief zone, the bottom strain relief zone and the rigid support section may be discrete components wherein the strain relief zones are formed by strain relief pads that are located adjacent to a rigid support member. The top strain relief zone provides cushioned support to the screen cloth around the edge of the screen frame adjacent to the opening. The bottom strain relief zone provides cushioning for the support screen.

The peripheral frame may include a reinforcement member encapsulated within the rigid support section to provide additional rigidity to the frame. A flange may extend outward from the peripheral frame, wherein the screen assembly is retained within the vibratory separator by placing the flange between adjacent housing members. The strain relief zone may extend around the rigid support section such that the flange is encapsulated by the strain relief zone.

In another aspect the claimed subject matter is generally directed to a frame for a self-cleaning screen assembly for a vibratory separator. The frame for the self-cleaning screen assembly includes a rigid support section formed from a polymer material having a first durometer and having an opening therethrough, a cushioned top strain relief zone made from a polymer material having a lower durometer than the first durometer and located on the top of the rigid support section adjacent to the opening, and a cushioned bottom strain relief zone made from a polymer material and having a lower durometer than the first durometer and located along the bottom of the rigid support section adjacent to the opening.

Other aspects and advantages of the claimed subject matter will be apparent from the following description and the appended claims.

DETAILED DESCRIPTION

Figure 1:
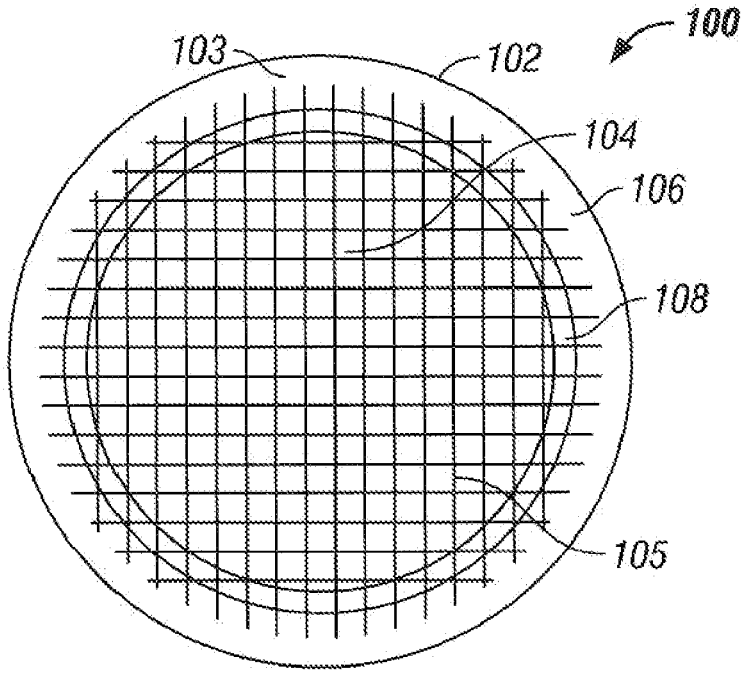
FIG. 1 is a top view of a screen assembly of the present invention.

The claimed subject matter relates to a screen assembly 100 for a vibratory separator. Referring to FIG. 1, the screen assembly includes a frame 103 and a screen cloth 104. The frame includes a peripheral frame 102, which defines an opening 105 and includes at least two sections, an outer, rigid support section 106 and an inner, cushioned strain relief zone 108. As shown in FIGS. 3A-3D, the screen cloth 104 is affixed to the frame 102.

Referring to FIGS. 3A-D, the rigid support section 106 and strain relief zone 108 are depicted. The strain relief zone 108 provides cushioned support to the screen cloth 104 when a load, such as product to be filtered or separated, is applied to the screen top surface 130. When a load is applied to the screen top surface 130, the wires 132 in the screen cloth 104 are pulled downward from the top mounting surface 110. Without strain relief zone 108, the wires 132 tend to bend along the inner edge 112 of the rigid support section 106. After some time, individual wires 132 often break inside the inner edge 112, due to strain and fatigue. The cushioned strain relief zone 108 absorbs a portion of the strain associated with the load on the screen top surface 130 in the area adjacent to the rigid support section 106. Fatigue and strain on individual wires 132 within the screen cloth 104 are reduced along the strain relief zone 108.

The rigid support section 106 may be formed from a polymer material, preferably polypropylene. The material forming the rigid support member 106 may be filled with reinforcement particles, such as talc or fiberglass. The material forming the rigid support section 106 has a first durometer, which is sufficient to provide rigidity and support to the screen frame 102.

Figure 2:
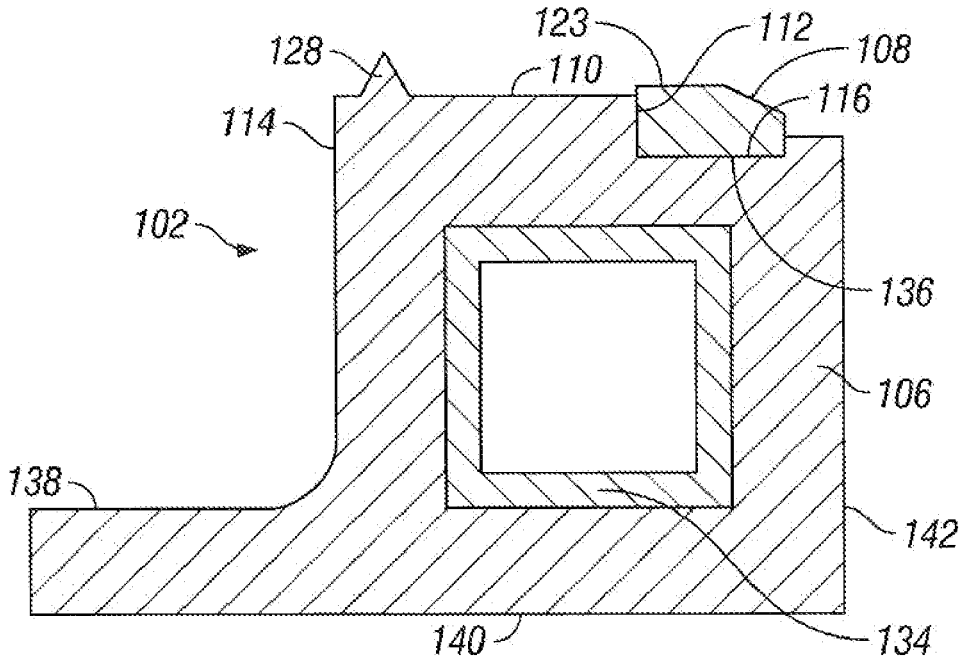
FIG. 2 is a cross sectional view of the screen frame.

Referring to FIG. 2, the peripheral frame 102 preferably includes a reinforcement member 134 encapsulated within the rigid support section 106. The reinforcement member 134 may be a metal tube that is welded and formed into the outer shape of the screen frame 102. The purpose of the reinforcement member 134 is to provide additional stability to the peripheral frame 102. One of skill in the art will of course appreciate that any material that provides additional stability may be used to form the reinforcement member 134, including metal and polymer composite materials.

The strain relief zone 108 is formed from a polymer having a second durometer, which is less than the first durometer of the material forming the rigid support member 106. The softer strain relief pad 108 should be made from an elastomeric material, with a thermoplastic elastomer being preferred. Thermoplastic elastomer is available in a variety of durometers and bonds well to polypropylene. Further, thermoplastic elastomer is approved by the FDA and is resistant to many chemicals. Both the strain relief zone 108 and the rigid support section 106 may be made from materials approved by the FDA for screen assemblies 100 to be used in production processes for food and pharmaceutical products.

The rigid support section 106 may be formed by molding the material in a typical molding process. The strain relief zone 108 may be formed by an extrusion which is assembled to the rigid support section 106 to form a frame 102. Alternatively, the strain relief zone 108 may be co-molded with the rigid support section 106 either simultaneously or consecutively in a typical co-molding or two-shot molding process. When the strain relief zone 108 is co-formed with the rigid support section 106, the choice of materials for each component must be carefully selected to ensure that the strain relief zone 108 will remain affixed to the rigid support section 106.

Continuing to refer to FIG. 2, the frame includes a top mounting surface 110, which may include one or more ridges 128 to provide material sufficient to bond the screen cloth 104 to the rigid support section 106 by a method such as hot plate welding or sonic welding. To attach the screen cloth 104 (see FIGS. 3A-D) to the top mounting surface 110, the peripheral edge of the screen cloth is tightened to pretension the screen. Localized energy may be directed to the ridges 128 to soften the material sufficiently for the screen cloth 104 to be embedded within the material. The softened material of the ridges and top mounting surface travels through the pores in the screen cloth edge and over the wires. Upon cooling, the screen cloth 104 is adjoined to the screen frame 102. Flash traps (not shown), which are grooves in the upper surface of the rigid support section 106, may be included to receive excess melted frame material when the screen cloth 104 is bonded to the screen frame 102.

In the preferred embodiment, the rigid support section 106 includes a groove 136 within which the strain relief zone 108 is located. The groove 136 is located near an inner edge 112 of the rigid support section. The groove bottom provides a support surface 116 and is located below the top mounting surface 110 such that a top surface 123 of the strain relief zone 108 is above the top mounting surface 110 of the rigid support section 106 before the screen cloth 104 is affixed to the screen frame 102. Before the screen cloth 104 is affixed to the rigid support member, the top surface 123 of the strain relief zone 108 is slightly higher than the top mounting surface 110. As shown in FIGS. 3A-D, when the screen cloth 104 is affixed to the top mounting surface 110, the strain relief zone 108 is compressed to provide support to the screen cloth 104 around the opening 105 defined by the screen frame 102. As a load is applied to the screen top surface 130, the strain relief zone 108 further compresses to prevent localized strain on the individual wires 132.

Referring again to FIG. 2, the rigid support section 106 of the peripheral frame 102 may include a flange 138 extending radially outward. As in typical screen assemblies for vibratory separators, the flange 138 extends outward along a bottom surface 140. The bottom surface 140 is substantially parallel to the top mounting surface 110 and an inner peripheral wall 142 extends between the top mounting surface 110 and the bottom surface 140. The flange 138 is located on the side opposing the inner peripheral wall 142 and is used to retain the screen assembly 100 within the vibratory separator (not shown). A gasket (not shown) typically is used to seal the interface between the separator components and the flange 138.

The strain relief zone 108 and rigid support section 106 may have different configurations, as shown in FIGS. 3A-D. In a first configuration, shown in FIG. 3A, the strain relief zone 108 is located along a support surface 116 of the rigid support section 106 adjacent to the inner surface 112. The strain relief zone 108 is compressed between the support surface 116 and the screen cloth 104.

Figure 3A:
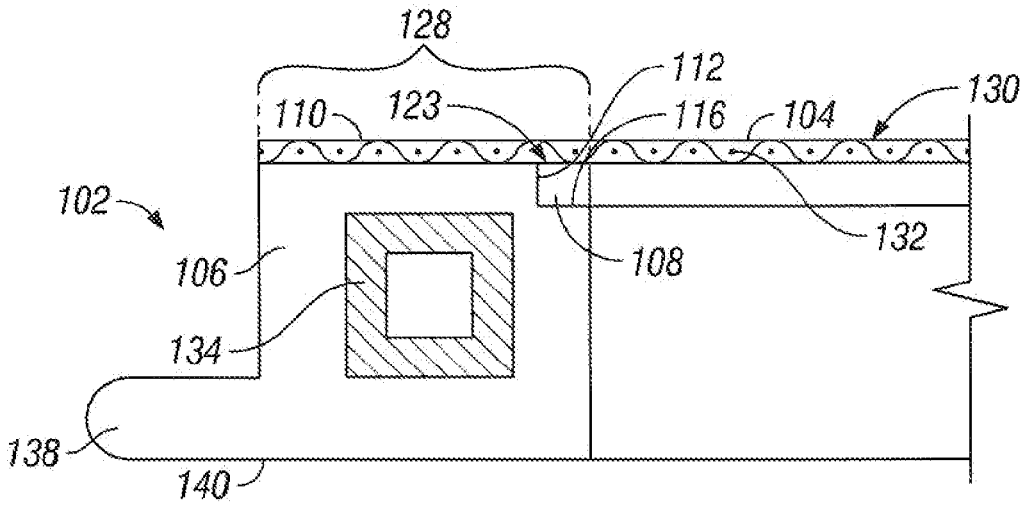
FIGS. 3A-D are cross sectional side views of screen assembly configurations.
Figure 3B:
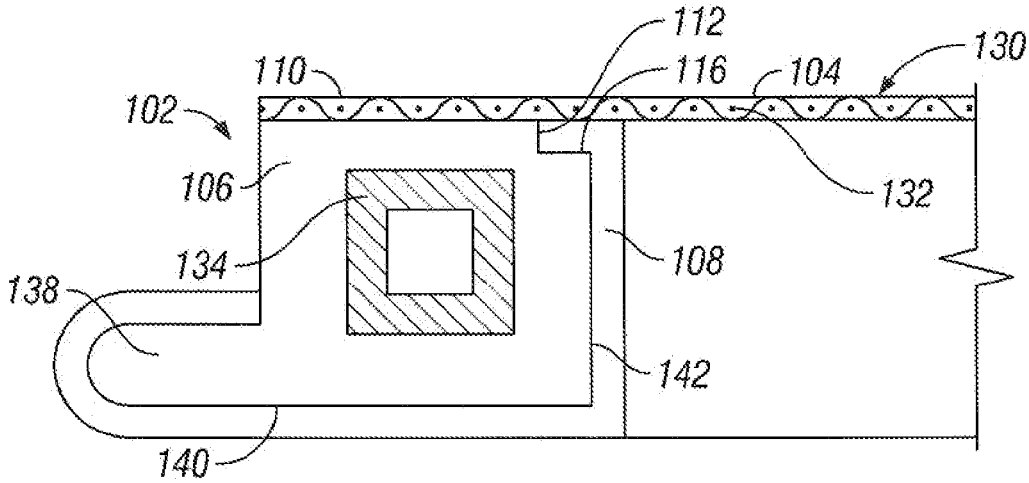

Referring to FIG. 3B, the strain relief zone 108 may encapsulate the rigid support section 106 from the inner surface 112 and support surface 116, along the inner perimeter wall 142, the bottom surface 140 and around the flange 138.

The strain relief zone 108 thus provides the strain relief to the screen cloth 104 as well as replacing the gasket typically used to seal the interface between the flange 138 and the vibratory separator components. The strain relief zone 108 may be extruded and pushed onto the rigid support section 106. Alternatively, the strain relief zone 108 may be co-formed with the rigid support section 106. When the strain relief zone 108 and the rigid support section 106 are co-formed, the molded strain relief and gasket are free from crevices, where bacteria can grow, and need not be removed when the screen is cleaned, a favorable feature for food and sanitary applications.

Figure 3C:
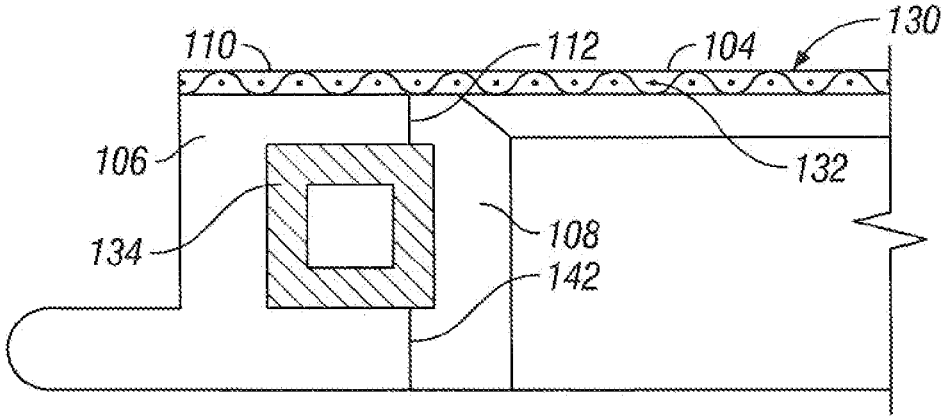

The strain relief zone 108 must be present at the interface of the frame 102 and the screen cloth 104. Referring to FIG. 3C, the strain relief zone 108 may encapsulate the inner peripheral wall 142 of the rigid support section 106. Such a configuration may be desirable for co-molding the frame 102 and minimizing crevices.

Figure 3D:
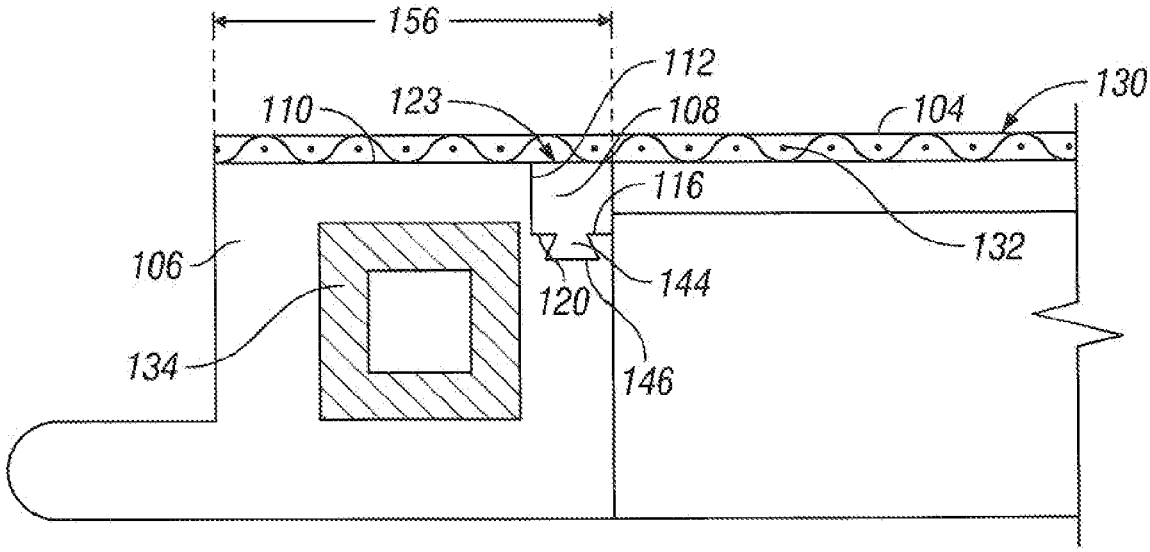

Referring to FIG. 3D, the strain relief zone 108 may include a rib 144 extending from a bottom surface 120. The rigid support section 106 includes a corresponding groove 146 in the support surface 116. The rib 144 fits within, and may be welded into, the groove 146 to retain the strain relief zone 108 in a fixed position relative to the rigid support section 106. The groove 146 may have a size and shape such that the rib 144 is compressed to fit within the groove and/or wherein the rib 144 is compressed immediately adjacent the pad bottom surface 120 to retain the rib 144 within the groove 146.

Figure 4:
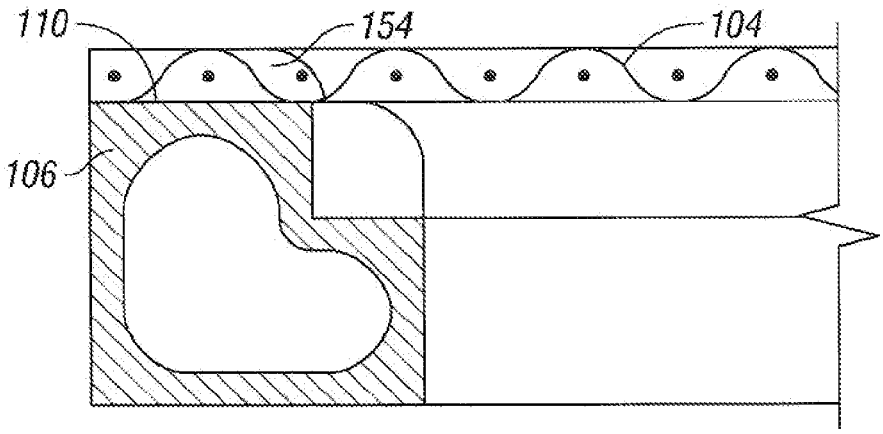
FIG. 4 is a cross sectional side view of a screen cloth adhered to the frame.

As shown in FIG. 4, the screen cloth 104 may be adhered to the top mounting surface 110 of the rigid support frame 106 with an epoxy 154. When the rigid support frame 106 is formed from a thermoset material, the screen cloth 104 cannot be encapsulated therein. Thus, an adhesive or epoxy 154 is needed to attach the screen cloth 104 to the frame 102.

Figure 5:
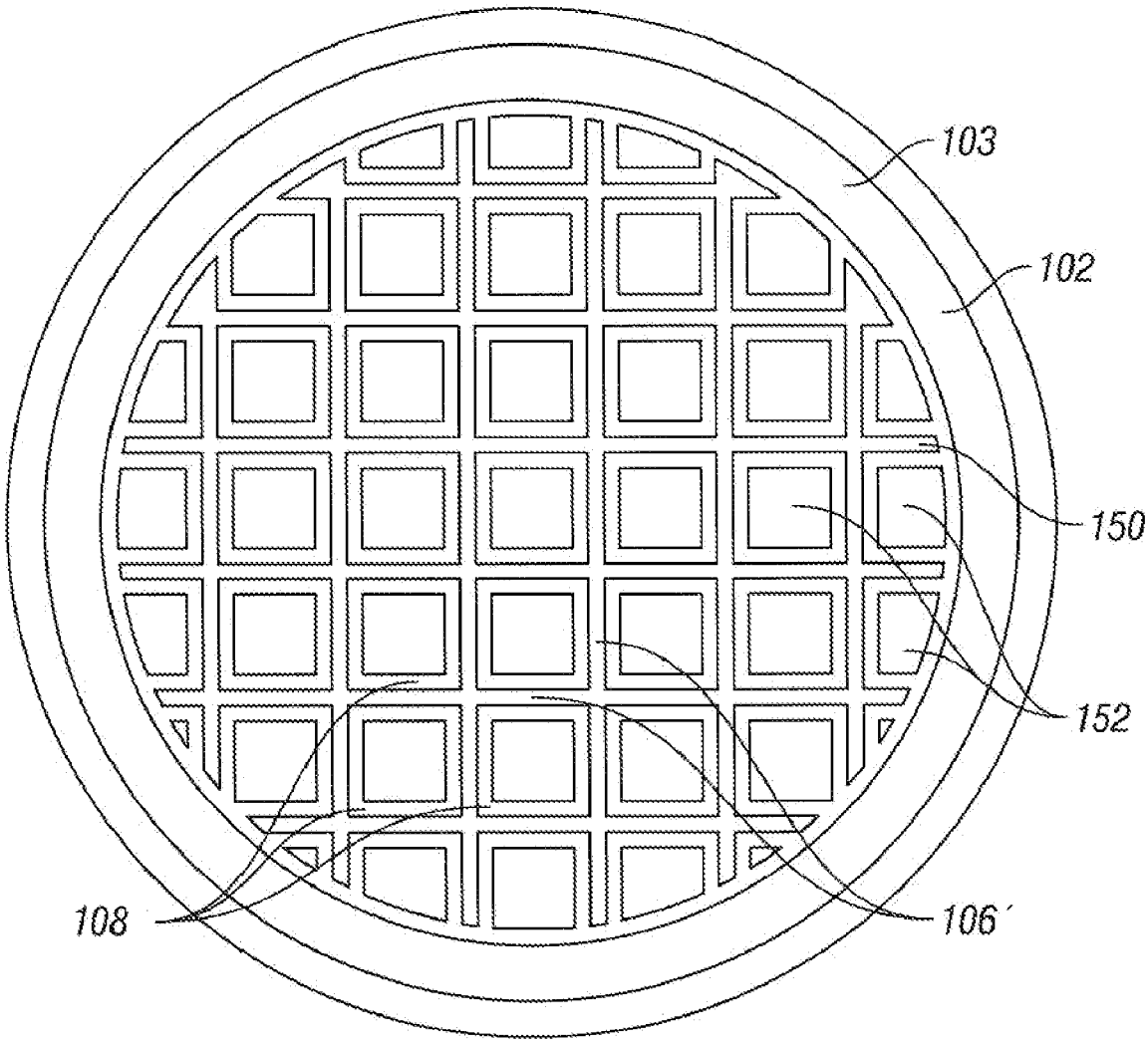
FIG. 5 is a top view of an embodiment of a screen frame.

Referring to FIG. 5, the screen frame 103 may include a peripheral screen frame 102 and an internal support frame 150. The internal support frame 150 is formed with and is contiguous with the peripheral screen frame 102 to create a plurality of openings 152 within the screen frame 103. The screen cloth 104 (shown in FIGS. 1, 3A-D, 4) may be affixed to the internal support frame 150. As a load applied to the screen top surface 130 over each opening 152 defined by the internal support frame 150, the individual wires 134 along the internal support frame 150 are strained. The internal support frame 150 includes a rigid support section 106' and strain relief zone 108'. Thus, each opening 152 defined by the internal support frame 150 has a strain relief zone 108' around its periphery. Such a configuration is desirable when it is anticipated that the screen cloth 104 will be subjected to heavy loads.

One of skill in the art will appreciate that configurations such as those already described for the strain relief zone 108 and rigid support section 106 with respect to the peripheral frame 102 are applicable to the internal support frame 150. Reinforcement rods (not shown) may be included within the rigid support section 106' of the internal support frame 150.

One of skill in the art will further appreciate that alternative configurations of an internal support frame 150 are possible with equally applicable rigid support section 106' and strain relief zone 108' configurations. For example, an internal support frame 150 creating openings 152 having a pie shape may be desirable, wherein the strain relief zones 108' are present around each opening 152.

Figure 6:
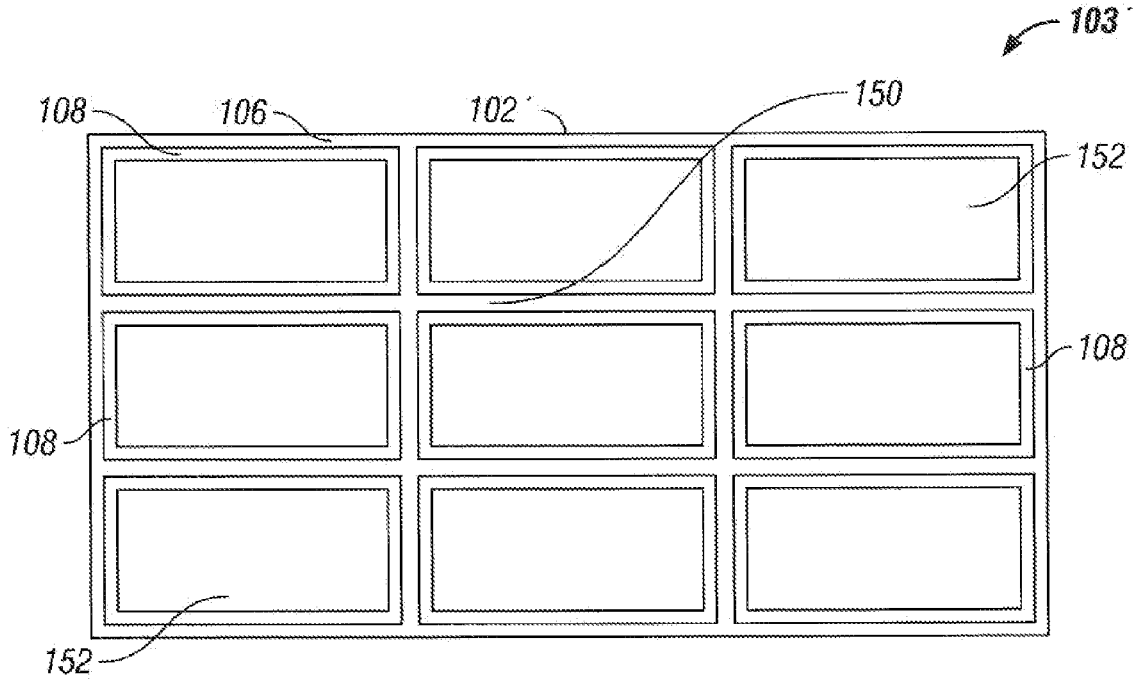
FIG. 6 is a top view of an embodiment of a screen frame.

One of skill in the art will further appreciate that the described screen frame 103' may be rectangular in shape, as shown in FIG. 6, having a peripheral frame 102' with or without an internal support frame 150. The screen frame 103' would include a rigid support section 106 and a strain relief zone 108 around each opening 152 within the screen frame 103'.

Figure 7A:
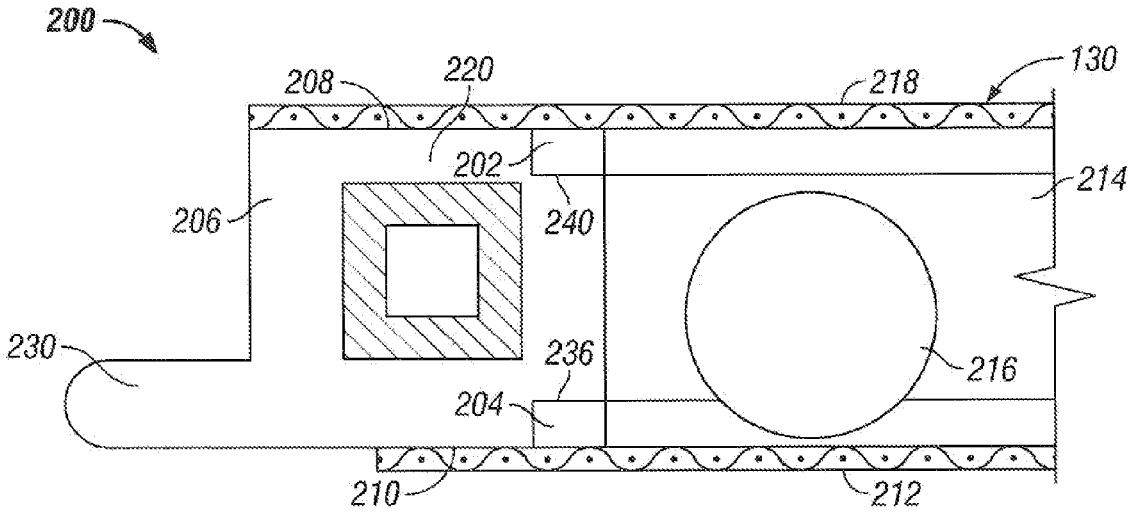
FIG. 7A is a cross sectional view of an embodiment of a self-cleaning screen frame.
Figure 7B:
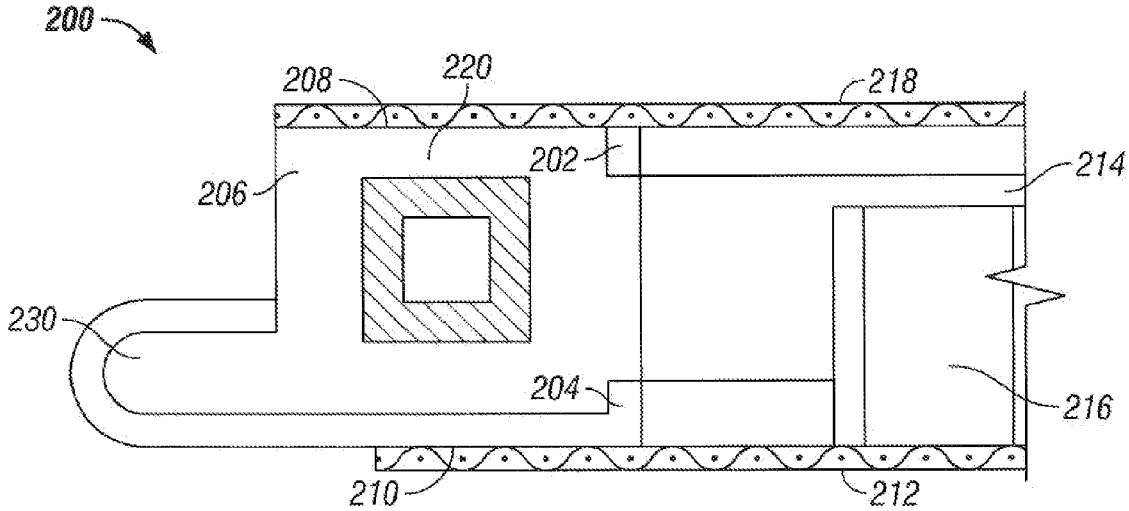
FIG. 7B is a cross sectional view of an embodiment of a self-cleaning screen frame.
Figure 7C:
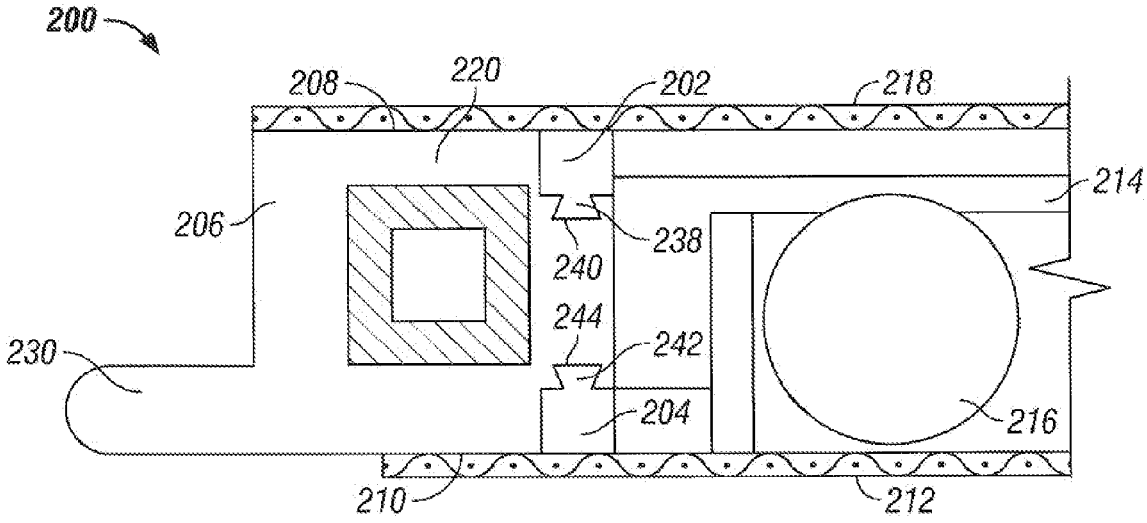
FIG. 7C is a cross sectional view of an embodiment of a self-cleaning screen frame.

Referring to FIGS. 7A-7C, a self-cleaning screen assembly 200 incorporating a top strain relief zone 202 and a bottom strain relief zone 204 are depicted. Self-cleaning screens, sometimes referred to as "sandwich screens" are often used when the separation process results in screen blinding. Screen blinding occurs when the screen mesh openings are blocked or closed by the material which is being screened. Particles that are nearly the size of the pore openings in the screen cloth become trapped or build up on the wires effectively blocking the screen openings, thereby preventing further material from passing through the screen. Also, very fine particles can build up or cake around the pores in the screen cloth, which can also prevent the screen openings from further material classification.

The self-cleaning screen assembly 200 includes a peripheral frame 206, which may be round or rectangular or of any other shape corresponding to the vibratory separator in which the self-cleaning screen assembly 200 is to be used. The peripheral frame 206 has a top mounting surface 208 and a bottom mounting surface 210. One or more screen cloths 218 are affixed to the top mounting surface 208 of the peripheral frame 200 across the opening 214. The screen cloths 218 may be affixed as previously described. A flow through support screen 212 is affixed to the bottom mounting surface 210 of the peripheral frame 200 across the opening 214. The support screen 212 may be made from a coarse wire mesh and, as will be explained, provides support to one or more cleaning elements 216 while allowing material filtered by the screen cloth 218 to pass through. The support screen 212 may also be affixed to the peripheral frame 200 in a like manner to the screen cloth 218.

To provide the self-cleaning function to the screen assembly, one or more cleaning elements 216 are positioned on the support screen 212 beneath the screen cloth 218. The cleaning elements may be balls that can move about between the support screen 212 and the screen cloth 218. Other cleaning elements known in the art may also be used, such as loose rings that slide on the support screen, known as "sliders", ball trays, or any combination of balls, sliders, and ball trays. The cleaning action occurs when the cleaning elements 216 bounce off the bottom of the support screen 212.

The peripheral frame 206 of the self-cleaning screen assembly 200 includes a rigid support section 220. A cushioned top strain relief zone 202 is located along a top portion of the peripheral frame 206 adjacent to the opening 214. The top strain relief zone 202 provides cushioned support to the screen cloth 218 when a load, such as product to be filtered or separated, is applied to the screen top surface 224, as previously described with respect to the screen assembly. A bottom strain relief zone 204 is located along a bottom portion of the peripheral frame 206 adjacent to the opening 214. The bottom strain relief zone 204 provides strain relief to the support screen 212 on which the cleaning elements 216 are located. The support screen 212 imparts energy to the cleaning elements 216 and in addition, the screening elements 216 bounce on the support screen 212. Thus, a more cushioned interface between the support screen 212 and the peripheral frame 206 can facilitate the trampoline effect of the support screen 212 while helping to protect the individual wires that make up the support screen 212.

As previously described, the rigid support section 220 may be formed from a polymer material, preferably polypropylene. The material forming the rigid support section 220 has a durometer sufficient to provide rigidity and support to the peripheral frame 206. The peripheral frame 206 may include a reinforcement member 226 encapsulated within the rigid support section 220 as previously described. The peripheral frame 206 may include a flange 230 extending radially outward. The flange 230 may be formed from the polymer from which the rigid support section 220 is formed.

The top strain relief zone 202 is formed from a polymer having a durometer, which is less than the durometer of the material forming the rigid support section 220. The softer top strain relief zone 202 may be made from an elastomeric material, with a thermoplastic elastomer being preferred. Thermoplastic elastomer is available in a variety of durometers and bonds well to polypropylene. Further, thermoplastic elastomer is approved by the FDA and is resistant to many chemicals. Both the top strain relief zone 202 and the rigid support section 220 may be made from materials approved by the FDA for self-cleaning screen assemblies 200 to be used in production processes for food and pharmaceutical products.

The bottom strain relief zone 204 is formed from a polymer having a durometer, which is less than the durometer of the material forming the rigid support section 220. The durometer of the bottom strain relief zone 204 may be the same as or greater than the durometer of the top strain relief zone 202. That is, the top strain relief zone 202 may be the same hardness or softer than the bottom strain relief zone 204. The bottom strain relief zone 204 may be made from an elastomeric material, with a thermoplastic elastomer being preferred. Because the support screen 212 is made from a more coarse mesh than the screen cloth 218, the bottom strain relief zone 204 does not need to be as forgiving as the top strain relief zone 202. The top strain relief zone 202 may be made from a first polymer and the bottom strain relief zone 204 may be made from a second polymer that differs from the first polymer.

The details of the interface between the screen cloth 218, the top strain relief zone 202 and the rigid support section will be the same as previously described with respect to the screen assembly.

The top and bottom strain relief zones 202 and 204 may be extruded and pushed onto the rigid support section 220. The rigid support section 220 may include a groove 234 in the top surface and/or a groove 236 in the bottom surface in which the corresponding extruded strain relief zone 202 or 204 is seated. Alternatively, the top and bottom strain relief zones 202 and 204 may be co-formed or comolded with the rigid support section 220. When the strain relief zones 202 and 204 and the rigid support section 220 are co-formed, the molded strain relief zones and the rigid support section 220 are free from crevices, where bacteria can grow, and need not be removed when the screen is cleaned, a favorable feature for food and sanitary applications. Further, flange 230 may also be encapsulated with the material from the bottom strain relief zone 204 or, if the same material is used for both the top and bottom strain relief zones 202 and 204, the flange 230 may be encapsulated along with the formation of the top and bottom strain relief zones 202 and 204 in a single co-molding procedure.

Referring to FIG. 7A, in a first configuration, the top strain relief zone 202 is located between a portion of rigid support section 220 adjacent to the opening through the peripheral frame 206 on one side and the screen cloth 228 on the top. The top strain relief zone 202 is compressed between the rigid support section 220 and the screen cloth 218. The bottom strain relief zone 204 is located between a lower portion of the rigid support section 220 adjacent to the opening through the peripheral frame 206 on one side and the support screen 212 on the bottom.

Referring to FIG. 7B, the bottom strain relief zone 204 may encapsulate a portion of the rigid support section 220 from the bottom strain relief zone 204, along the bottom mounting surface 210 and around the flange 230. The bottom strain relief zone 204 thus provides the strain relief to the support screen 212 as well as replacing the gasket (not shown) that is typically used to seal the interface between the flange 230 and the vibratory separator components (not shown) that retain the self-cleaning screen assembly in place.

Referring to FIG. 7C, the top strain relief zones 202 may include a rib 238 extending from a bottom surface. The rigid support section 220 may include a corresponding groove 240 in the support surface. The rib 238 fits within, and may be welded into, the groove 240 to retain the strain relief zone 202 in a fixed position relative to the rigid support section 220. The groove 240 may have a size and shape such that the rib 238 is compressed to fit within the groove and/or wherein the rib 238 is compressed immediately adjacent the bottom surface of the strain relief zone 202 to retain the rib 238 within the groove 240. The bottom strain relief zone 204 may also include a rib 242 extending from a top surface that fits within a corresponding groove 244 in the rigid support section 220 in the same manner as that described for the top strain relief zone 204.

While the claimed subject matter has been described with respect to a limited number of embodiments, those skilled in the art, having benefit of this disclosure, will appreciate that other embodiments can be devised which do not depart from the scope of the claimed subject matter as disclosed herein. For example, the use of anti-bacterial additives to the screen frame. Accordingly, the scope of the claimed subject matter should be limited only by the attached claims.

What is claimed is:

1. A self-cleaning screen assembly for a vibratory separator comprising:

a peripheral frame around an opening, wherein the frame has a top mounting surface and a bottom mounting surface;

at least one screen cloth affixed to the top mounting surface over the opening, wherein the screen cloth has a screen top surface and a screen bottom surface;

a flow through support screen affixed to the bottom mounting surface across the opening;

at least one cleaning element between the support screen and the screen cloth; and wherein the peripheral frame comprises:

a rigid support section made from a polymer material having a first durometer to which the screen cloth and support screen are each affixed; and a cushioned top strain relief zone made from a polymer material having a lower durometer than the first durometer and located between the rigid support section and the opening adjacent to the top mounting surface such that the screen bottom surface is supported by the strain relief zone;

a cushioned bottom strain relief zone made from a polymer material and having a lower durometer than the first durometer and located between the rigid support section and the opening adjacent to the bottom mounting surface.

2. The self-cleaning screen assembly of claim 1 wherein the durometer of the top strain relief zone and the durometer of the bottom strain relief zone are equal.

3. The self-cleaning screen assembly of claim 1 wherein the durometer of the top strain relief zone is less than the durometer of the bottom strain relief zone.

4. The self-cleaning screen assembly of claim 3 wherein the top strain relief zone is made from a first polymer and the bottom strain relief zone is made from a second polymer.

5. The self-cleaning screen assembly of claim 1, further comprising:

a reinforcement member encapsulated within the rigid support section of the peripheral frame, wherein the reinforcement member provides additional rigidity to the peripheral frame.

6. The self-cleaning screen assembly of claim 1 wherein the peripheral frame further comprises:

a flange extending radially outward, wherein the flange is made from the polymer material having the first durometer.

7. The self-cleaning screen assembly of claim 1 wherein the top strain relief zone is formed by an extrusion; and wherein the rigid support section of the peripheral frame has a groove in which the extrusion is seated such that the extrusion provides support to the screen bottom surface.

8. The self-cleaning screen assembly of claim 1 wherein the top strain relief zone and the rigid support section and the bottom strain relief zone are comolded.

9. The self-cleaning screen assembly of claim 1, wherein the cleaning element is one or more objects selected from the group consisting of: slider, ball, and ball tray.

10. A frame for a self-cleaning screen assembly to be used in a vibratory separator, wherein the self-cleaning screen assembly includes at least one screen cloth having a screen bottom surface, at least one flow through support screen, and at least one cleaning element between the support screen and the screen cloth, the frame comprising:

a rigid support section formed from a polymer material having a first durometer and having an opening therethrough, wherein the screen cloth is affixed to the rigid support section over the opening; and a cushioned top strain relief zone made from a polymer material having a lower durometer than the first durometer and located on the top of the rigid support section adjacent to the opening; and a cushioned bottom strain relief zone made from a polymer material and having a lower durometer than the first durometer and located along the bottom of the rigid support section adjacent to the opening.

11. The frame of claim 10, wherein the rigid support section further comprises:

a flange extending outward from a frame periphery; and wherein the bottom strain relief zone encapsulates the flange.

12. The frame of claim 10 and the durometer of the top strain relief zone and the durometer of the bottom strain relief zone are equal.

13. The frame of claim 10 wherein the durometer of the top strain relief zone is less than the durometer of the bottom strain relief zone.

14. The frame of claim 10 wherein the top strain relief zone is formed by an extrusion;

wherein the rigid support section has a groove in a top surface near the opening in which the top strain relief zone is seated;

wherein the bottom strain relief zone is formed by a second extrusion; and wherein the rigid support section has a second groove in a bottom surface near the opening in which the bottom strain relief zone is seated.

15. The frame of claim 10 wherein the rigid support section, the top strain relief zone and the bottom strain relief zone are co-molded.

16. The frame of claim 10, further comprising:

a reinforcement member encapsulated within the rigid support section.

* * * * *